US005345913A

United States Patent [19]

Belshaw et al.

[11] Patent Number: 5,345,913

[45] Date of Patent: Sep. 13, 1994

[54] INJECTOR ASSEMBLY

[75] Inventors: Barry L. Belshaw, Washburn; James K. Berry; Michael A. Marz, both of Peoria; John E. Tisch, Edelstein, all of Ill.

[73] Assignee: Caterpillar Inc., Peoria, Ill.

[21] Appl. No.: 157,786

[22] Filed: Nov. 24, 1993

[51] Int. Cl.[5] ..... F02M 61/14

[52] U.S. Cl. ..... 123/470

[58] Field of Search ..... 123/468, 469, 470, 294

[56] References Cited

U.S. PATENT DOCUMENTS

| | | | |
|---|---|---|---|
| 2,777,431 | 1/1957 | Meurer | 123/470 |
| 3,038,456 | 6/1962 | Dreisin | 123/470 |
| 3,125,078 | 3/1964 | Reiners | 123/470 |
| 3,334,617 | 8/1967 | Palkowsky | 123/470 |
| 4,066,213 | 1/1978 | Stampe | 123/470 |
| 4,141,329 | 2/1979 | Pompei | 123/537 |
| 4,419,977 | 12/1983 | Hillebrand | 123/502 |
| 5,024,193 | 6/1991 | Graze, Jr. | 123/259 |

FOREIGN PATENT DOCUMENTS

| | | | |
|---|---|---|---|
| 204195 | 3/1955 | Australia . | |
| 2003302 | 4/1983 | Fed. Rep. of Germany . | |
| 3340445 | 5/1985 | Fed. Rep. of Germany . | |
| 2066895 | 7/1981 | United Kingdom | 123/470 |
| 2155559 | 5/1987 | United Kingdom . | |

*Primary Examiner*—E. Rollins Cross
*Assistant Examiner*—Thomas N. Moulis
*Attorney, Agent, or Firm*—Diana L. Charlton

[57] ABSTRACT

The design and construction of past injector assemblies having an injector sleeve manufactured from a deformable material used the deforming characteristics of the injector sleeve to form a combustion seal separating a combustion chamber from a cooling liquid jacket. Additionally, the injector sleeve was generally used in conjunction with a resilient means to form the coolant seal between the cooling liquid jacket and a fuel injector. Deforming the injector sleeve to produce the combustion seal made it difficult to remove during inspections and maintenance schedules and virtually impossible to reuse. The present invention overcomes these problems by providing an injector sleeve manufactured from a relatively non-deformable material which is used in conjunction with a plurality of seal rings to establish only a coolant seal between the cooling liquid jacket and a fuel injector. An injector cone has a tapered lower portion which is seated in a frusto-conical portion disposed within a cylinder head to establish an independent combustion seal.

18 Claims, 3 Drawing Sheets

INJECTOR ASSEMBLY

TECHNICAL FIELD

This invention relates generally to an injector assembly for use in an internal combustion engine and more particularly to the sealing capabilities of the injector assembly.

BACKGROUND ART

It is well known in the art to utilize an injector assembly which has an injector sleeve manufactured from a deformable material such as brass or copper. Corresponding to its deformable nature, the injector sleeve can be swaged or pressed under pressure to form a combustion seal. Additionally, the injector sleeve is normally used in conjunction with a resilient means to form a cooling liquid seal.

An example of an injector assembly is disclosed in U.S. Pat. No. 3,334,617 issued to Glenn L. Palkowsky on Aug. 8, 1967 wherein an injector-receiving copper tube extends through a coolant water jacket. Leakage between the coolant jacket and a combustion chamber due to thermal distortion of the combustion chamber wall is prevented by providing an annular ring on the tube which engages an annular sealing surface in a lower wall of a cylinder head extending parallel to the plane of the wall. The sealing force on the ring is obtained by clamping the injector against an annular surface of the tube interior adjacent the position of the annular ring. The tube end is deformed into a counterbore extending upwardly from the combustion chamber surface of the lower wall to positively retain the tube in the lower wall and the clamping force positively seals the wall and the clamping force positively seals the joint. Additionally, the injector tube includes a cylindrical upper portion having an outwardly directed flange at the upper end, which engages an o-ring seal carried in a counterbored portion of an opening in the upper wall of the cylinder head to prevent leakage of coolant from the water jacket. As with conventional injector assemblies, the invention disclosed by Palkowsky utilizes a deformable injector tube which is deformed during installation by the clamping force of the injector in order to retain the injector tube in the cylinder head and to form a combustion seal. Periodically, however, the injector tube and surrounding structures or seals may need to be inspected during normal maintenance schedules. In order to remove the injector tube, it would have to be destroyed because the deformation of the injector tube would make it virtually impossible to remove the injector tube intact. The destruction of the injector tube could allow fragments of the injector tube to enter the combustion chamber leading to possible failure of the engine. Moreover, the injector tube once removed, would always have to be replaced at an additional cost. Additionally, the use of a deformable injector tube would decrease the stability of the injector assembly because deformable materials tend to relax and lose their sealing capabilities over time. Furthermore, by associating the injector tube with both the combustion seal and the cooling liquid seal, any damage to the injector tube could potentially allow combustion and cooling liquid leakage.

The present invention discloses an injector assembly adapted for use in an internal combustion engine which provides improved combustion and cooling liquid sealing without the use of deforming specific components.

Therefore, the present invention can be easily assembled and disassembled without damage to any of the injector assembly components making the manufacture and maintenance of the invention less costly, time-consuming, and hazardous to the life of the engine. Furthermore, the use of non-deformable materials increases the reliability of the injector assembly by increasing stability of both the coolant and combustion seals.

DISCLOSURE OF THE INVENTION

In one aspect of the present invention an injector assembly is adapted for use in an internal combustion engine. The internal combustion engine includes a cylinder block which defines a cylinder bore, a cylinder head attached to the cylinder block in closing relation to the cylinder bore and having upper and lower walls which partially define a cooling liquid jacket portion, a piston is reciprocally mounted in the cylinder bore and defines with the cylinder block a variable volume combustion chamber, a pair of axially aligned openings extend through the upper and lower walls with the opening through the lower wall communicating with the combustion chamber. The opening through the lower wall includes a bore, an annular shoulder generally facing the cooling liquid jacket portion, and a frusto-conical portion converging outwardly from the annular shoulder towards the combustion chamber. The injector assembly includes a non-deformable injector sleeve which has a lower annular surface seated against the annular shoulder when in use and an upper annular surface opposite the lower annular surface. The injector sleeve when in use is disposed at least partially in the upper and the lower wall openings and extends through the cooling liquid jacket portion. An injector cone includes a lower portion which extends through the injector sleeve and an upper portion which has a top surface and a bottom surface adjacent the upper annular surface of the injector sleeve. A fuel injector extends through the injector cone and is adapted for connection in the cylinder head when in use and includes a connecting portion connected to the upper portion of the injector cone.

In another aspect of the present invention an internal combustion engine includes a cylinder block which defines a cylinder bore, a cylinder head attached to the cylinder block in closing relation to the cylinder bore and having upper and lower walls which partially define a cooling liquid jacket portion, and a piston reciprocally mounted in the cylinder bore and which define with the cylinder block a variable volume combustion chamber. The cylinder head includes a pair of axially aligned openings through the upper and lower walls with the opening through the lower wall communicating with the combustion chamber. The opening through the lower wall includes a bore, an annular shoulder generally facing the cooling liquid jacket portion, and a frusto-conical portion converging outwardly from the annular shoulder towards the combustion chamber. A non-deformable injector sleeve has a lower annular surface which is seated against the annular shoulder and has an upper annular surface opposite the lower annular surface. The injector sleeve is disposed at least partially in the upper and the lower wall openings and extends through the cooling liquid jacket portion. An injector cone includes a lower portion which extends through the injector sleeve and an upper portion which has a top surface and a bottom surface adjacent the upper annular surface of the injector sleeve. A fuel injector extends through the injector cone in connection with the cylinder head and includes a connecting portion connected to the upper portion of the injector cone.

The present invention, through the use of a non-deformable injector sleeve, has increased stability and reliability and decreased time and cost associated with the assembly and disassembly of the invention.

BEST MODE FOR CARRYING OUT THE INVENTION

Figure 1:
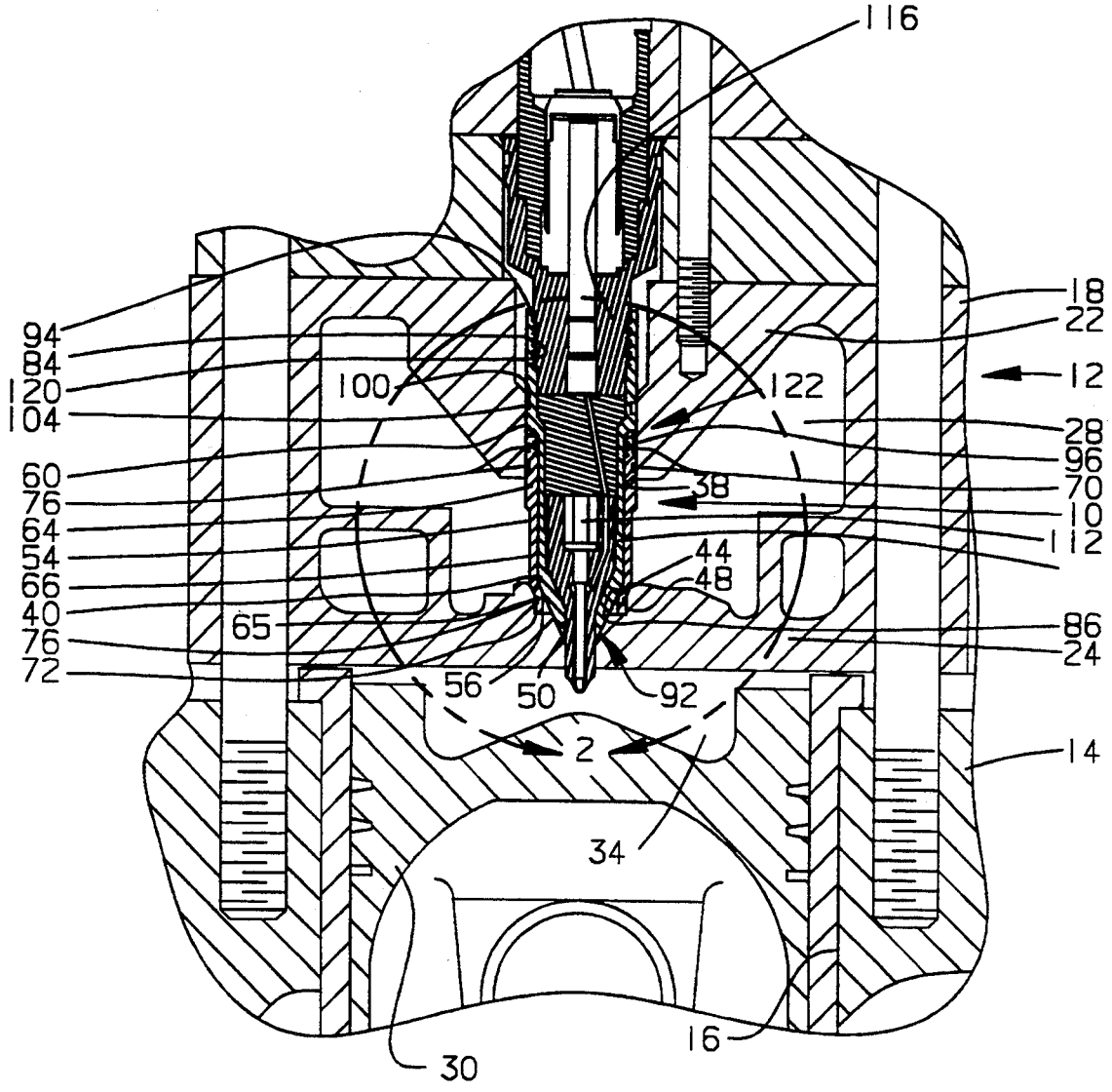
FIG. 1 is a partial cross-sectional view of an internal combustion engine embodying the present invention.

An injector assembly 10 for an internal combustion engine 12 is shown in FIG. 1. The engine 12 includes a cylinder block 14 which defines a bore 15 having a cylinder liner 16 therein defining a cylinder bore 17. A cylinder head 18 is releasably attached to the cylinder block 14 in closing relation to the cylinder bore 17. The cylinder head 18 has upper and lower walls 22 and 24, respectively, with the upper and lower walls 22,24 partially defining a cooling liquid jacket 28. A piston 30 is reciprocally mounted in the cylinder bore 17 and defines with the cylinder liner 16 a variable volume combustion chamber 34. Axially aligned openings 38 and 40 are defined in the upper and lower walls 22,24, respectively, with the opening 40 in the lower wall 24 communicating with the combustion chamber 34. The opening 40 in the lower wall 24 includes a bore 44, an annular shoulder 48 generally facing the cooling liquid jacket 28, and a frusto-conical portion 50 converging outwardly from the annular shoulder towards the combustion chamber 34. The frusto-conical portion 50 has a predetermined included angle x, shown in FIG. 2.

Figure 2:
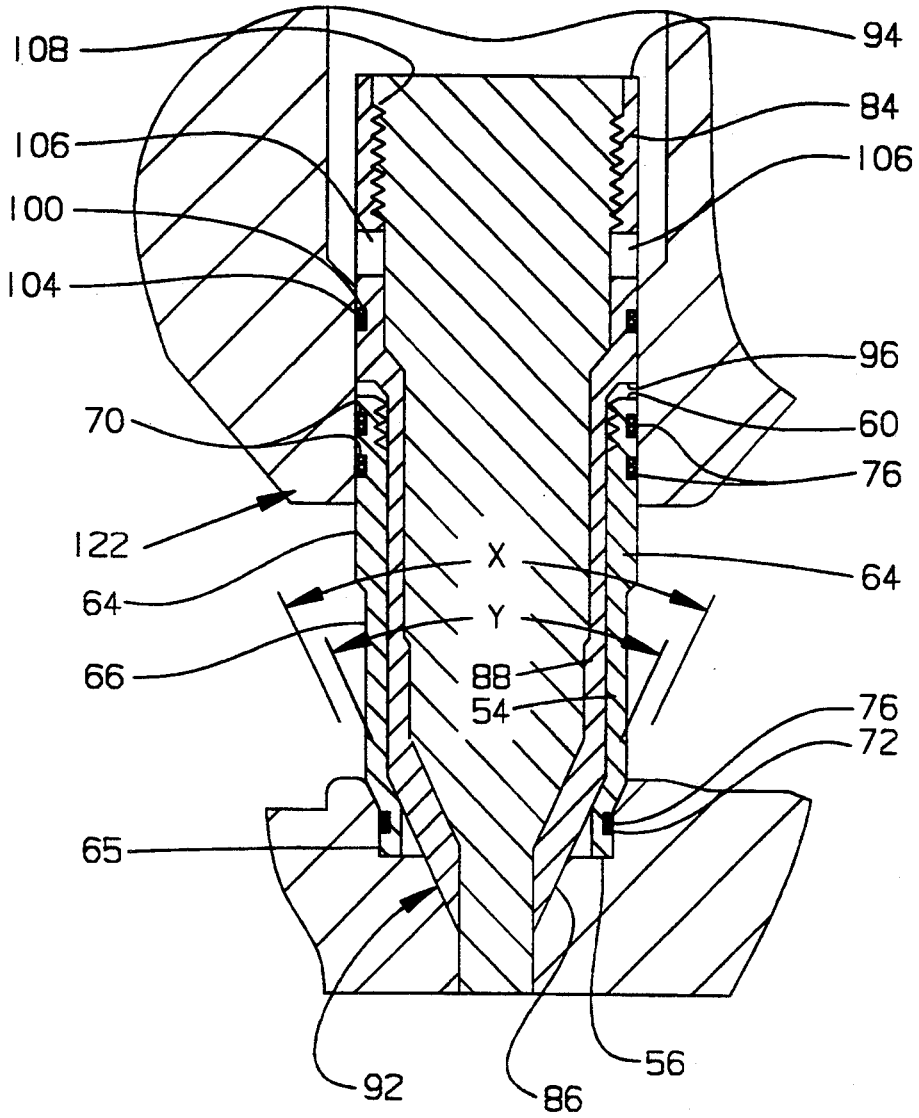
FIG. 2 is an enlarged partial section of the area designated by line 2—2 of FIG. 1.
Figure 3:
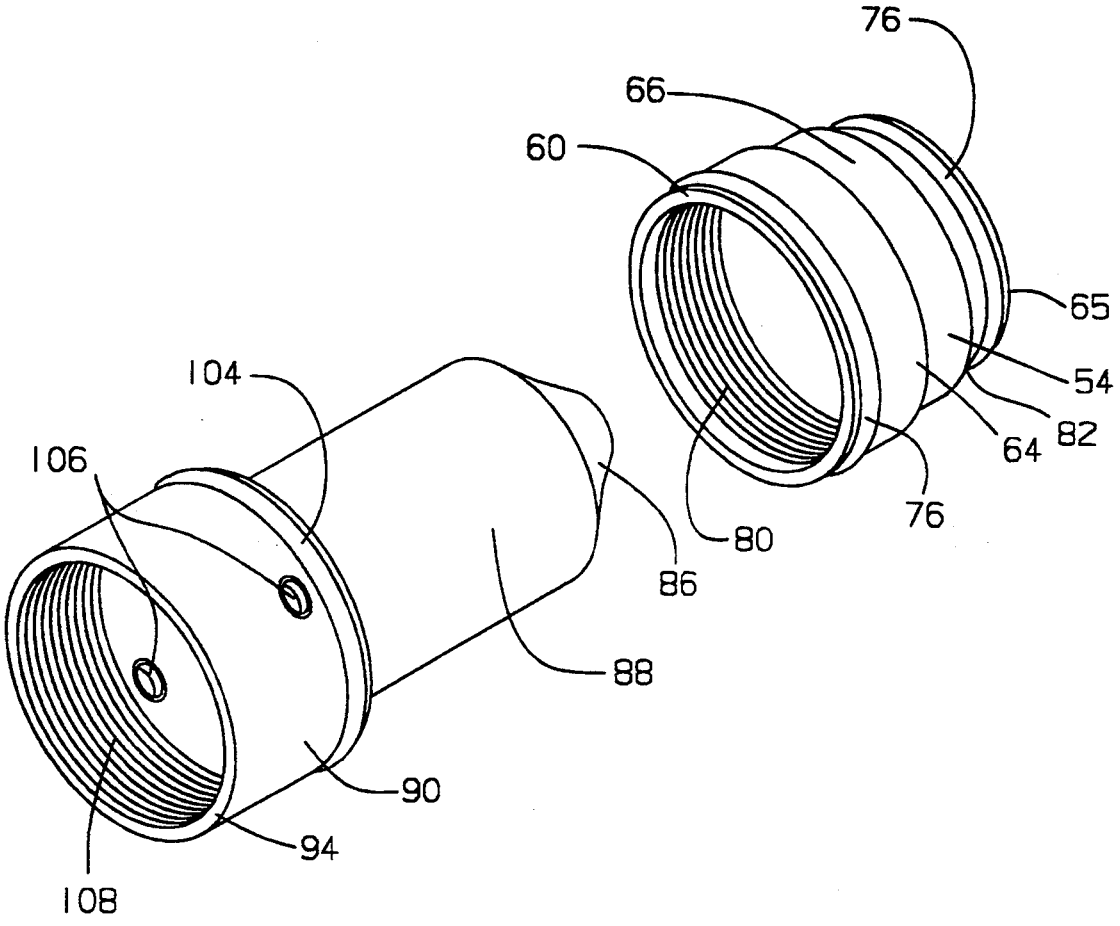
FIG. 3 is an partial exploded assembly view of one aspect of the present invention.

Referring to FIGS. 1–3, an injector sleeve 54 is partially disposed within the upper and lower wall openings 38,40 within the cylinder head 18. The injector sleeve 54 is manufactured from a material, such as stainless steel, or any other suitable material which is less deformable than typically used brass or copper injector sleeves. The injector sleeve 54 may be carried in the openings 38,40 in any suitable manner, such as by a press fit. The injector sleeve 54 has a lower annular surface 56 which seats against the annular shoulder 48, an upper annular surface 60 opposite the lower surface, and upper, lower, and central cylindrical portions 64, 65 and 66, respectively. The upper cylindrical portion 64 includes a pair of upper annular outer grooves 70 which extend peripherally thereabout. The lower cylindrical portion 66 includes a lower annular outer groove 72 which extends peripherally thereabout. An o-ring coolant seal 76 is seated in each of the pair of upper grooves 70 and the lower groove 72 so that when the injector sleeve 54 is assembled into the cylinder head 18, the upper cylindrical portion 64 is disposed in the opening 38 in the upper wall 22 and the lower cylindrical portion 66 is press fit into the bore 44 in the opening 40 in the lower wall 24 for sealing engagement. The upper cylindrical portion 64 has an inner threaded portion 80. The lower cylindrical portion 66 has an inner tapered portion 82 converging outwardly from the central cylindrical portion 65 toward the lower cylindrical portion 66.

An injector cone 84 is disposed within the injector sleeve 54 and has a lower generally tapered portion 86, a central portion 88, and an upper portion 90. The lower tapered portion 86 has a predetermined included angle y less than the included angle x, generally within 1 degree. The lower and central portions 86,88 extend through the injector sleeve 54 until the lower tapered portion 86 sealingly seats on the frusto-conical portion 50 of the opening 40 in the lower wall 24 to provide a means 92 for sealingly separating the combustion chamber 34 from the cooling liquid jacket 28. The upper portion 90 has a top surface 94, a bottom surface 96 adjacent the upper annular surface 60, and an annular outer groove 100 disposed near the bottom surface 96 and extending peripherally thereabout. An o-ring fuel seal 104 is seated in the annular outer groove 100 in the upper portion 90 of the injector cone 84 for sealing engagement with the opening 38 in the upper wall 22. A pair of fuel communication ports 106 are positioned upwardly of the fuel seal 104 in the upper portion 90 of the injector cone 84. The upper portion 90 has a inner threaded portion 108 extending from the top surface 94 and terminating adjacent the pair of fuel communication ports 106.

A fuel injector 112 is shown specifically in FIG. 1 and is connected to the cylinder head 18 in a manner that allows the injector 112 to extend through the injector cone 84 in order to communicate with the combustion chamber 34. The injector includes a connecting portion 116 which has an outer threaded portion 120 which is threaded into the inner threaded portion 108 of the injector cone 84 to hold the injector 112 in position within the cylinder head 18. The press fit of the injector sleeve 54 in combination with the coolant seal o-rings 76 provides a means 122 for sealingly isolating the cooling liquid jacket 28 from the fuel injector 112. The isolating means 122 functions separately from the separating means 92.

Industrial Applicability

During operation of the internal combustion engine 12 and at specific cyclic intervals, the injector 112 injects fuel received from an outside source (not shown) into the combustion chamber 34. The introduction of fuel combined with high pressure air already within the combustion chamber 34, ignites the fuel/air mixture and results in increased temperatures in and around the combustion chamber 34 during the combustion process. In order to reduce temperatures, coolant is circulated through the cooling liquid jacket 28 and around the injector sleeve 54. However, during the circulation of coolant around the injector sleeve 54, coolant must be kept isolated from the fuel injector 112 so that no fuel becomes contaminated. This is accomplished through the sealing engagement between the injector sleeve 54 and the cylinder head 18 established by the o-ring coolant seals 76. The press-fit of the injector sleeve 54 allows the coolant seals 76 to keep the coolant within the cooling liquid jacket 28 and away from the fuel injector 112. The non-deformable characteristics of the steel injector sleeve 54 allows for a much more reliable and stable seal between the cooling liquid jacket 28 and the fuel injector 112 because the steel does not relax over time as does conventional brass or copper materials.

It is also important during the combustion process to separate the combustion gases from the cooling liquid jacket 28 so that no coolant becomes contaminated. This is accomplished through the seal that is established when the lower tapered portion 86 of the injector cone 84 is seated against the frustoconical portion 50 of the cylinder head 18. The included angle y of the lower tapered portion 86 is substantially 1 degree less than the included angle x of the frusto-conical portion 50 developing a wedge fit between the components and sealing the combustion chamber 34. Therefore, it is not necessary to deform the injector sleeve 54 in order to develop this sealing engagement for the combustion seal. More specifically, the injector sleeve 54 is used only as a coolant seal and is completely independent from development of the combustion seal.

During normal maintenance schedules or repairs, the injector sleeve 54 may need to be removed to replace the coolant o-ring seals 76. The injector sleeve 54 is removed by threading a slide hammer or similar device (not shown) into the inner threaded portion 80 to pull the injector sleeve 54 free in a conventional manner. Since the coolant seal does not rely on any deformation of the injector sleeve 54 and the combustion seal is provided on a separate component, the injector sleeve 54 can be removed without damage thereto. The removed injector sleeve 54 may be reused by seating new o-rings in the grooves 70, 72 and press-fitting the injector sleeve 54 back into the cylinder head 18.

In view of the above, it is apparent that the present invention provides an injector assembly having an improved sealing design and a non-deformable injector sleeve. Cooling liquid sealing can be obtained through the use of a press-fit injector sleeve having o-ring seals and combustion sealing can be obtained through the use of a separate injector cone having a tapered portion seated against a frustoconical portion of the opening in the lower wall within the cylinder head without the use of deforming the injector sleeve. The present invention can be easily assembled and disassembled without damage to the injector sleeve making the manufacture and maintenance of the invention less costly, time-consuming, and hazardous to the life of the engine. Furthermore, the use of non-deformable materials increases the reliability of the injector assembly by increasing sealing stability.

We claim:

1. An injector assembly adapted for use in an internal combustion engine including a cylinder block defining a bore having a cylinder liner therein defining a cylinder bore, a cylinder head attached to the cylinder block in closing relation to the cylinder bore and having upper and lower walls partially defining a cooling liquid jacket portion, a piston reciprocally mounted in the cylinder bore and defining with the cylinder liner a variable volume combustion chamber, a pair of axially aligned openings through the upper and lower walls with the opening through the lower wall communicating with the combustion chamber and including a bore, an annular shoulder generally facing the cooling liquid jacket portion, and a frusto-conical portion converging outwardly from the annular shoulder towards the combustion chamber, comprising:

a non-deformable injector sleeve having a lower annular surface seating against the annular shoulder when in use and an upper annular surface opposite the lower annular surface, the injector sleeve when in use disposed at least partially in the upper and the lower wall openings and extending through the cooling liquid jacket portion;

an injector cone including a lower portion extending through the injector sleeve and an upper portion having a top surface and a bottom surface adjacent the upper annular surface of the injector sleeve; and a fuel injector extending through the injector cone and adapted for connection with the cylinder head when in use and including a connecting portion connected to the upper portion of the injector cone.

2. The injector assembly of claim 1, wherein the upper portion of the injector cone has an inner threaded portion and the connecting portion of the fuel injector has an outer threaded portion threaded into the inner threaded portion of the injector cone.

3. The injector assembly of claim 2, including means for sealingly separating the combustion chamber from the cooling liquid jacket portion when in use so that combustion gases are prevented from leaking into the cooling liquid.

4. The injector assembly of claim 3, including means for sealingly isolating the cooling liquid jacket portion from the fuel injector when installed.

5. The injector assembly of claim 4, wherein the separating means includes the lower portion of the injector cone having a generally tapered shape adapted for sealing engagement with the frusto-conical portion of the opening in the lower wall when installed.

6. The injector assembly of claim 5, wherein the isolating means includes the injector sleeve having an upper cylindrical portion adapted for sealing engagement with the upper wall when in use and a lower cylindrical portion adapted for sealing engagement with the lower wall when in use.

7. The injector assembly of claim 6, wherein the upper cylindrical portion includes an upper annular groove extending peripherally thereabout, the lower cylindrical portion includes a lower annular groove extending peripherally thereabout, and a seal ring is seated in both the upper annular groove and the lower annular groove.

8. The injector assembly of claim 7, wherein the lower cylindrical portion is press fit into the bore in the opening of the lower wall.

9. The injector assembly of claim 8, wherein the upper cylindrical portion of the injector sleeve has an inner threaded portion adapted for attachment of a tool during disassembly.

10. An internal combustion engine including a cylinder block defining a bore having a cylinder liner therein defining a cylinder bore, a cylinder head attached to the cylinder block in closing relation to the cylinder bore and having upper and lower walls partially defining a cooling liquid jacket portion, and a piston reciprocally mounted in the cylinder bore and defining with the cylinder liner a variable volume combustion chamber, comprising:

a pair of axially aligned openings through the upper and lower walls with the opening through the lower wall communicating with the combustion chamber and including a bore, an annular shoulder generally facing the cooling liquid jacket portion, and a frusto-conical portion converging outwardly from the annular shoulder towards the combustion chamber;

a non-deformable injector sleeve having a lower annular surface seating against the annular shoulder and an upper annular surface opposite the lower annular surface, the injector sleeve disposed at least partially in the upper and the lower wall openings and extending through the cooling liquid jacket portion;

an injector cone including a lower portion extending through the injector sleeve and an upper portion having a top surface and a bottom surface adjacent the upper annular surface of the injector sleeve; and a fuel injector extending through the injector cone in connection with the cylinder head and including a connecting portion connected to the upper portion of the injector cone.

11. The injector assembly of claim 10, wherein the upper portion of the injector cone has an inner threaded portion and the connecting portion of the fuel injector has an outer threaded portion threaded into the inner threaded portion of the injector cone.

12. The injector assembly of claim 11, including means for sealingly separating the combustion chamber from the cooling liquid jacket portion so that combustion gases are prevented from leaking into the cooling liquid.

13. The injector assembly of claim 12, including means for sealingly isolating the cooling liquid jacket portion from the fuel injector.

14. The injector assembly of claim 13, wherein the separating means includes the lower portion of the injector cone having a generally tapered shape adapted for sealing engagement with the frusto-conical portion.

15. The injector assembly of claim 14, wherein the isolating means includes the injector sleeve having an upper cylindrical portion in sealing engagement with the upper wall and a lower cylindrical portion in sealing engagement with the lower wall.

16. The injector assembly of claim 15, wherein the upper cylindrical portion includes an upper annular groove extending peripherally thereabout, the lower cylindrical portion includes a lower annular groove extending peripherally thereabout, and a seal ring is seated in both the upper annular groove and the lower annular groove.

17. The injector assembly of claim 16, wherein the lower cylindrical portion is press fit into the bore in the opening of the lower wall.

18. The injector assembly of claim 17, wherein the upper cylindrical portion of the injector sleeve has an inner threaded portion adapted for attachment of a tool during disassembly.

* * * * *